US006095636A

United States Patent [19]

Shioya et al.

[11] Patent Number: 6,095,636

[45] Date of Patent: Aug. 1, 2000

[54] INK JET PRINTING METHOD AND INK JET PRINTING APPARATUS

[75] Inventors: Makoto Shioya, Tokyo; Ken Tsuchii, Sagamihara, both of Japan

[73] Assignee: Canon Kabushiki Kaisha, Tokyo, Japan

[21] Appl. No.: 08/821,733

[22] Filed: Mar. 20, 1997

[30] Foreign Application Priority Data

Mar. 26, 1996 [JP] Japan ..... 8-070232

[51] Int. Cl.[7] ..... B41J 2/21; B41J 2/17

[52] U.S. Cl. ..... 347/43; 347/95; 347/96

[58] Field of Search ..... 347/96, 100, 43, 347/95, 98

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,315,382 | 5/1994 | Tanioka | 358/523 |
| 5,635,969 | 6/1997 | Allen | 347/96 |

FOREIGN PATENT DOCUMENTS

| | | |
|---|---|---|
| 0 657 849 | 6/1995 | European Pat. Off. . |
| 0 726 155 | 8/1996 | European Pat. Off. . |
| 54-56847 | 5/1979 | Japan . |
| 56-84992 | 7/1981 | Japan . |
| 59-123670 | 7/1984 | Japan . |
| 59-138461 | 8/1984 | Japan . |
| 60-71260 | 4/1985 | Japan . |
| 60-157865 | 8/1985 | Japan . |
| 61-249755 | 11/1986 | Japan . |
| 64-63185 | 3/1989 | Japan . |
| 8-216393 | 8/1996 | Japan . |

*Primary Examiner*—N. Le
*Assistant Examiner*—Thinh Nguyen
*Attorney, Agent, or Firm*—Fitzpatrick, Cella, Harper & Scinto

[57] ABSTRACT

An ink jet printing method makes it possible to prevent bleeding, which may take place if non-permeative ink of different colors are in contact with each other on a paper sheet, by selecting according to image information either a step A of providing a processing liquid, at first, in the area on a printing material for images to be printed thereon, and then, providing such ink or a step B of providing such ink, at first, in the area on the printing material for images to be printed thereon, and then, providing such liquid.

8 Claims, 7 Drawing Sheets

INK JET PRINTING METHOD AND INK JET PRINTING APPARATUS

BACKGROUND OF THE INVENTION

1. Field of the Invention

The present invention relates to an ink jet printing apparatus and an ink jet printing method. More particularly, the invention relates to an ink jet printing apparatus that discharges to a printing material ink and a liquid that contains a processing liquid to insolubilize or coagulate ink for printing, and also, relates to an ink jet printing method.

2. Related Background Art

The ink jet printing method has advantages such as low noises, lower running costs, and ease with which it can be fabricated more compactly, and for color use as well. This method is widely adopted for a printer, a copying apparatus, a facsimile equipment, and many others.

For the conventional ink jet printing method, there has been often used a paper sheet specially formed with an ink absorbing layer having a good water-resistance capability for obtaining a high color image without ink spreads, while maintaining a good water-resistance capability of ink on the material used for printing. However, with improvement in the quality of ink, the adoptability of use for the ink jet printing apparatus is being enhanced even to its use on an ordinary paper sheet in recent years. The ordinary sheets are used in a large quantity for a printer, a copying apparatus, or the like. Nevertheless, the quality of images printed on the ordinary sheet still remains at the level of a stage that needs more improvements. In this respect, several technical proposals have been made to attempt the enhancement of the water-resistance capability and the quality of print with respect to the use of an ordinary sheet.

As one of such proposals, there is known a method to enhance the water-resistance capability of images by improving the quality of ink, such as making the colorant contained in ink water-resistant. However, the ink used for such method is fundamentally hard to be dissolved again by water after drying. Therefore, the discharge ports and others of the printing head tend to be clogged. It may be possible to prevent this from taking place, but the structure of the apparatus should become more complicated inevitably.

Also, a method is disclosed in the specification of Japanese Patent Laid-Open Application No. 56-84992 to coat a material to fix dyes in advance on a printing material. However, this method makes it necessary to use a specific printing material that enables such fixing material to be coated on such material. Also, in order to coat the material to fix dyes in advance, the apparatus should be made larger, leading to the inevitable cost increase. Furthermore, it is comparatively difficult to coat such material to fix dyes stably on a printing material in a given film thickness.

Furthermore, for the enhancement of the quality of printed images, it is necessary to satisfy the aspects given below.

1. Characters and images should be printed sharply so that no feathering occurs to blur the edges of dot configurations irregularly when formed by discharged ink; and 2. Images should be printed clearly without any bleeding caused by the mixture of different colors of ink at boundaries between them.

However, in order to prevent the occurrence of feathering referred to in the above paragraph 1, there is a need for ink not to be permeated into the printing material. Here, the water-based ink that is usually used for the performance of an ink jet method is liable to create bleeding. On the contrary, if it is made to allow ink to permeate into a printing material, feathering tends to take place, although the occurrence of bleeding referred to in the above paragraph 2 can be reduced.

With a view to solving the problems described above, a technique is proposed in the specifications of Japanese Patent Laid-Open Application No. 64-63185 and Japanese Patent Laid-Open Application No. 61-249755, among some others, in which an arrangement is made to cause a colorless liquid that insolubilizes dyes to adhere to a printing material together with ink by use of an ink jet head.

In accordance with such technique, it is possible to obtain a high water-resistance capability, because color ink is insolubilized and fixed on a printing material. Also, it becomes possible to suppress the occurrences of feathering and bleeding at a time if such processing liquid is provided under a given condition in advance.

However, there is still a problem that it takes a time to fix ink, because this method requires a larger amount of liquid to be applied to a printing material in total.

To avoid this problem, it is effective to arrange the fixing speed faster by making either one or both of ink and processing liquid easily permeative into a printing material.

If a permeative ink is provided before processing liquid, feathering takes place because ink permeates into the irregular meshes of a paper sheet. However, if a permeative processing liquid is provided before the application of ink, colorant in ink is insolubilized or coagulated by such processing liquid make ink not to be easily permeated, thus reducing the occurrence of feathering. The resultant image quality is improved significantly.

In the meantime, if non-permeative ink is applied before the provision of processing liquid, it becomes possible to form images of excellent quality with almost no feathering.

Compared to the so-called preceding application, that is, processing liquid is provided before ink, a smaller amount of processing liquid is needed for the so-called post-application, that is, the permeative ink is applied before the provision of processing liquid when used for obtaining the water-resistance capability of a same degree. Therefore, it has an advantage that the running costs are made lower. This is due to the fact that in order to effectuate the provision of water-resistance capability, it is good enough if only the colorant existing near the surface layer of a paper sheet should be insolubilized or coagulated, and it is not considered necessary to permeate the processing liquid further into the deeper layer of the paper sheet.

Nevertheless, there is still a problem that bleeding takes place if non-permeative ink of different colors are in contact with each other on a paper sheet.

SUMMARY OF THE INVENTION

In consideration of the related art described above, the present invention is designed. It is an object of the invention to provide an ink jet printing method, and an ink jet printing apparatus, which make it possible to obtain a high water-resistance capability, while reducing the generation of feathering and bleeding irrespective of the kinds of image information and ink to be used for printing.

It is another object of the invention to provide an ink jet printing method for printing by the provision of plural kinds of ink and a liquid that contains a substance to insolubilize or coagulate colorant in each ink, the method being made capable of selecting according to image information either the step A of:

providing such liquid at first in an area on a printing material where images are printed, and then, applying ink; or the step B of:

providing ink at first in the area on the printing material where images are printed, and then, applying such liquid.

It is still another object of the invention to provide an ink jet printing apparatus for printing by the provision of plural kinds of ink and a liquid that contains a substance to insolubilize or coagulate colorant in each ink, comprising the following:

means for discharging the aforesaid ink;

means for discharging the aforesaid processing liquid; and printing control means for selecting either a mode to apply ink to the area on a printing material where images are printed after the provision of processing liquid or a mode to apply processing liquid to the area on the printing material where images are printed after the provision of ink in accordance with image information, and then, printing by use of the ink discharging means and liquid discharging means.

DETAILED DESCRIPTION OF THE PREFERRED EMBODIMENTS

Hereinafter, with reference to the accompanying drawings, the preferred embodiments of the present invention will be described in detail.

(Embodiment 1)

Figure 1:
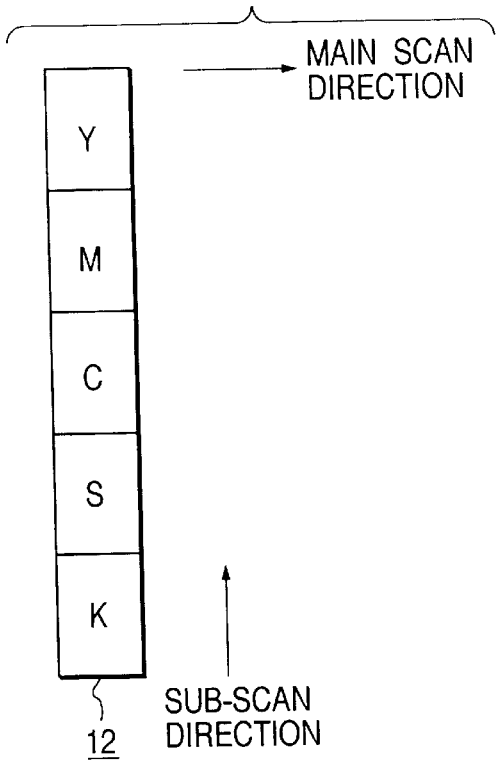
FIG. 1 is a front view which shows one example of the ink jet printing head suitably applicable to the implementation of the ink jet printing method of the present invention.
Figure 2:
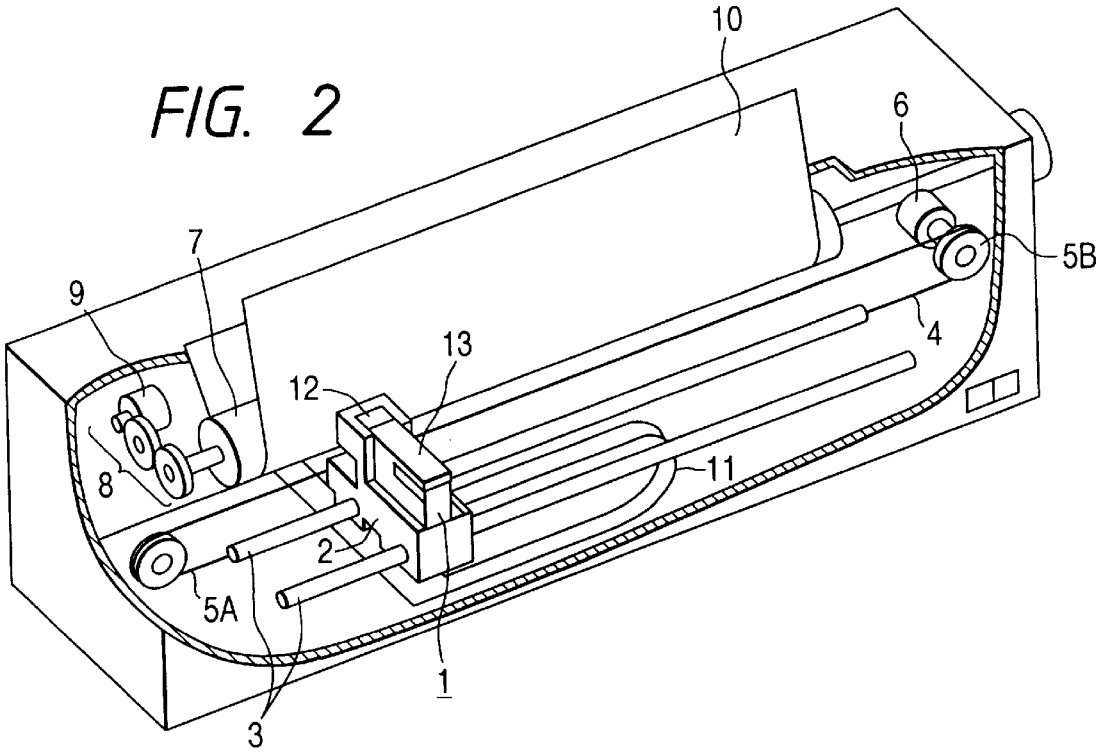
FIG. 2 is a perspective view which schematically shows the principal part of one example of the ink jet printing apparatus capable of mounting the ink jet printing head represented in FIG. 1.

FIG. 1 is a front view which shows one example of the ink jet printing head suitably applicable to the implementation of the ink jet printing method of the present invention. FIG. 2 is a perspective view which schematically shows the principal part of one example of the ink jet printing apparatus capable of mounting the ink jet printing head represented in FIG. 1. In this respect, the processing liquid which will be described later is used for the embodiments given below as the liquid that contains a substance to insolubilize or coagulate colorant in each ink.

As shown in FIG. 1, the ink jet printing head 12 is provided with discharge ports to discharge Y ink (yellow), M ink (magenta), C ink (cyan), S liquid (processing liquid), and K ink (black). One discharge port array is separated and shared by the discharge ports of each color. The discharge ports are arranged at intervals of 62.5 $\mu$m, for example, in the sub-scanning direction (the direction in which a printing material is carried) as shown in FIG. 1, and 60 pieces are assigned to each of the discharge ports of colors and liquid, Y, M, C, S, and K, respectively, for example.

Also, the ink jet printing head 12 is provided with heaters in each of the ink paths conductively connected to each of the discharge ports to generate thermal energy utilized for discharging. The heaters generate heat in response to electric pulses applied in accordance with driving data. In this way, film boiling is created in ink so that ink droplets or droplets of processing liquid are discharged from the aforesaid discharge ports along the development of air bubbles formed by means of such film boiling.

The ink jet printing head 12 thus structured constitutes an ink jet unit 1 together with the ink tank 2 that retains each ink and processing liquid as shown in FIG. 2.

The ink jet unit 1 is detachably mounted on a carriage 2. The carriage 2 travels while being guided by two shaft guides 3, which slidably engage with a part of the carriage. In this respect, the traveling of the carriage 2 is made possible by means of a belt 4 attached to a part thereof and tensioned around pulleys 5A and 5B when the belt 4 is driven by the driving force of a motor 6 through the pulleys 5A and 5B. A flexible cable 11 is connected with the head, through which discharge signals and control signals are transmitted from a host apparatus or a controller installed on the main body of the apparatus to the head driving circuit (head driver) installed on a part of the head.

A platen roller 7 extends in parallel with the guide shaft 3 in the longitudinal direction thereof, and is driven to rotate by means of a sheet feed motor 9 to carry a printing sheet 10, while regulating the printing surface of the printing sheet 10. With the structure described above, the respective discharge ports of the ink jet unit 1 for each color are enabled to discharge ink to the printing surface, that is, the respective portions of the printing sheet 10 that face each of the discharge ports for the execution of printing.

Figure 3:
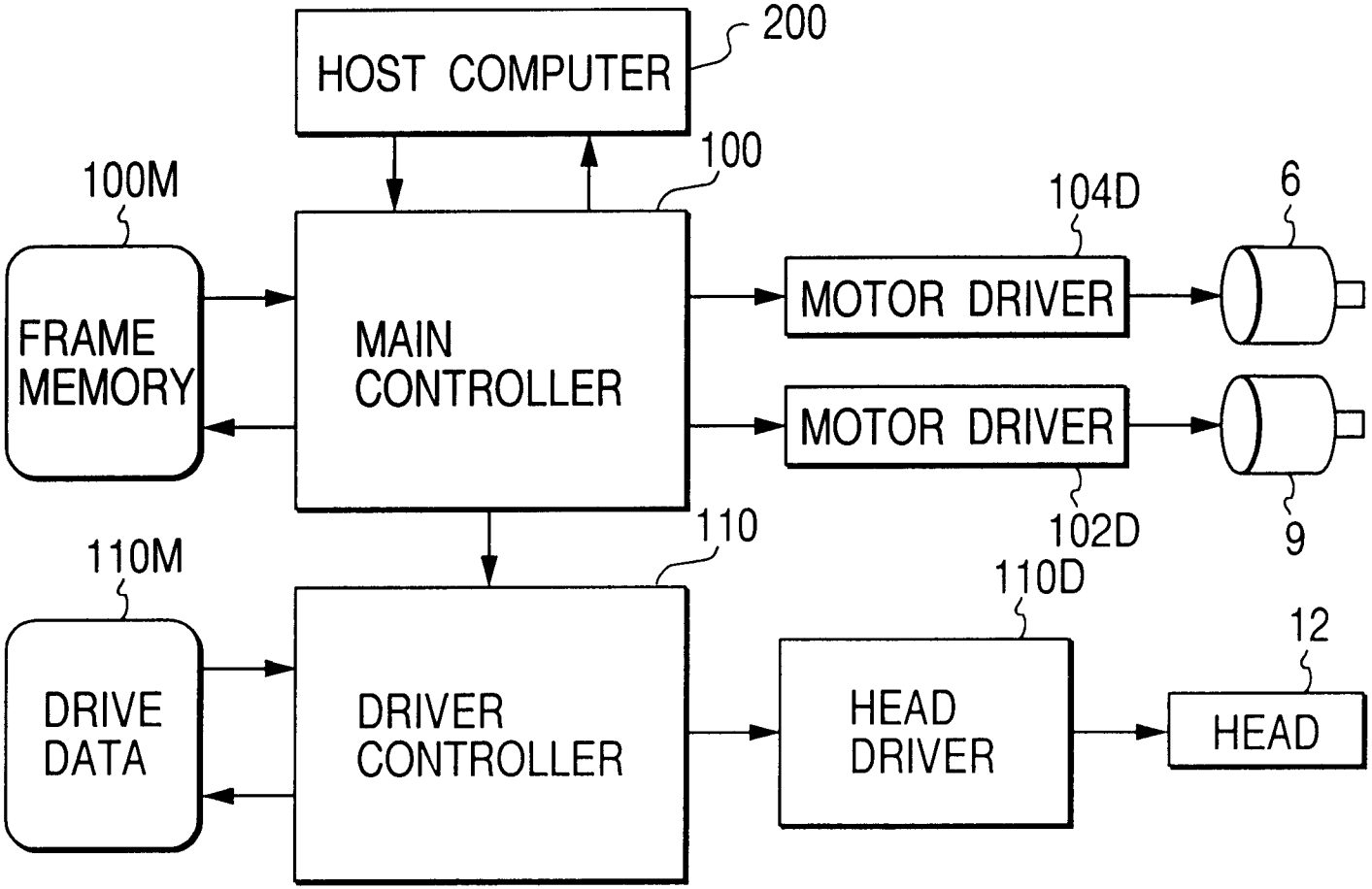
FIG. 3 is a block diagram which shows the control structure of the printing apparatus represented in FIG. 2.

FIG. 3 is a block diagram which shows the control structure of the ink jet printing apparatus represented in FIG. 2.

The main controller 100 comprises a CPU and others. It stores image data transmitted from the host computer 200 in the frame memory 100M. Also, the main controller 100 supplies image data stored in the frame memory 100M to the driver controller 110 per pixel at a given timing. The driver controller 110 converts the image data thus supplied to discharge data (data that indicates on and off of each heater on the head 12) with respect to the discharge port numbers (that indicate nth number thereof in the discharge port array on the printing head 12) and the scanning numbers (that indicate nth main scanning), and stores them on the drive data RAM 110M. Then, with reference to the discharge port numbers and scanning numbers as well, the driver controller 110 reads out the drive data stored in the drive data RAM 110 in accordance with the control signals transmitted from the main controller 100, and supplies them to the head driver 110D, while controlling its drive timing simultaneously.

With the structure described above, the main controller 100 controls the discharges of ink of each color and processing liquid by means of the head 12, the rotations of the carriage motor 6 and the sheet feed motor 9 through the driver controller 110, motor driver 104D, and motor driver 102D, respectively. In this way, characters, images, and the like are being printed on a printing sheet in accordance with the image data.

In this respect, the above structure is arranged so as to allow the driver controller 110 to convert the discharge data. However, it may be possible to arrange the main controller 100 to execute this conversion. In such case, the discharge data can be stored in the frame memory, thus excluding the provision of the RAM 110M.

Now, the following processing liquid and ink are used:

| | |
|---|---|
| <Composition of processing liquid> | |
| PAA-HC1-3L | 5.0 wt % |
| (Manufactured by Nitto Boseki Co., Ltd.) | |
| Cation G50 | 1.0 wt % |
| (Manufactured by Sanyo Chemical Industries, Ltd.) | |
| Diethylene glycol | 10.0 wt % |
| Lithium acetate | 0.5 wt % |
| Water | 83.5 wt % |
| <Composition of ink (black)> | |
| Glycelin | 5.0 wt % |
| Thiodiglycol | 5.0 wt % |
| Urea | 5.0 wt % |
| C.I. food black 2 | 3.5 wt % |
| Water | 81.5 wt % |
| <Composition of ink (color)> | |
| Glycelin | 7.5 wt % |
| Thiodiglycol | 7.5 wt % |
| Urea | 7.5 wt % |
| Dyestuff | 3.5 wt % |
| Y C.I. direct yellow 142 | |
| M C.I. direct red 289 | |
| C C.I. direct blue 199 | |
| Acetylenol EH | 1.0 wt % |
| (Manufactured by Kawaken Fine Chemical Co., Ltd.) | |
| Water | 73.0 wt % |

In accordance with the printing method of the present invention, printing is executed by use of the printing apparatus, printing head, ink and processing liquid, which are described above. To the area where images have already been printed in black ink, processing liquid is applied afterward, while processing liquid is provided for the area where images should be printed in color ink before the application of color ink.

As a result, the occurrence of feathering is smaller in the portions where the images are printed in black ink. The images are obtained with sharp edges. Also, the images are obtained in good condition having a smaller amount of bleeding between each of the color boundaries, such as between color and black, and color and color.

(Embodiment 2)

Figure 4:
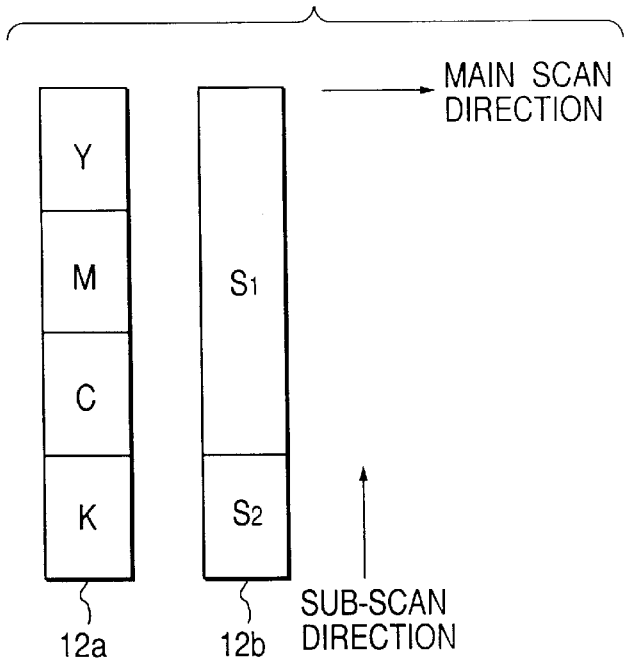
FIG. 4 is a front view which shows another example of the ink jet printing head suitably applicable to the implementation of the ink jet printing method of the present invention.
Figure 5:
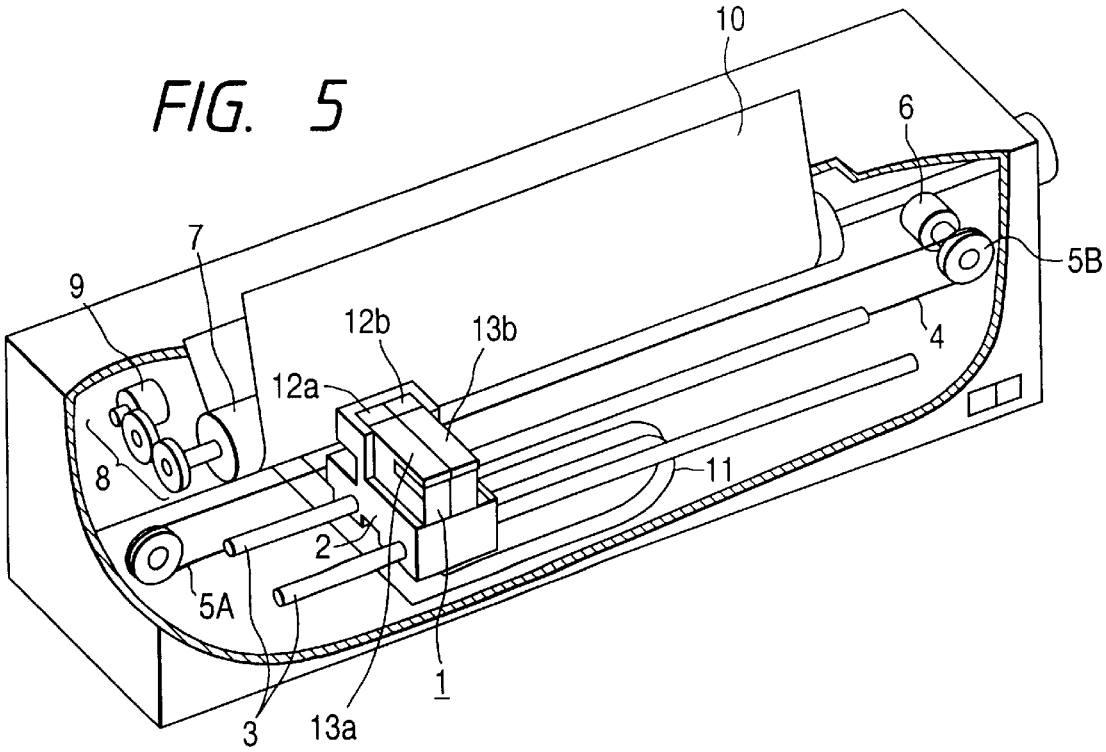
FIG. 5 is a perspective view which schematically shows the principal part of another example of the ink jet printing apparatus capable of mounting the ink jet head represented in FIG. 4.

FIG. 4 is a front view which schematically shows another example of the ink jet printing head suitably applicable to the implementation of the ink jet printing method of the present invention. FIG. 5 is a perspective view which schematically shows the principal part of another example of the ink jet printing apparatus capable of mounting the ink jet head represented in FIG. 4. In this respect, among the constituents of the present embodiments, those which are the same as the constituents of the previous embodiment are provided with the same reference marks, and the description thereof will be omitted.

In FIG. 4, the ink jet printing head 12*a* is provided with the discharge ports that discharge Y ink (yellow), M ink (magenta), C ink (cyan), and K ink (black), respectively. Also, the ink jet printing head 12*b* is for discharging S liquid (processing liquid), and provided with a discharge port group $S_1$ for use of the Y, M, and C of the head 12*a*, and a discharge port group $S_2$ for use of the K of the head 12*a*. On the head 12*a* and head 12*b*, tanks 13*a* and 13*b* are detachably installed.

When printing is executed in K ink (black) in accordance with the present embodiment, the printing is made, at first, by use of only K of the head 12*a* with its preceding scan, and then, by use of the discharge port group $S_1$ of the head 12*b*, and the post application of processing liquid is executed with its post scanning. After that, when printing is made in C ink (cyan), processing liquid is provided for the area where C is to be shot by use of the discharge port group $S_1$ before C ink is shot in order to avoid any bleeding between K and C. More specifically, before the discharge port group C of the head 12*a* passes the area where K has already been shot, OR is executed between the K that has already been shot and the C to be shot, and then, for the resultant area thus obtained, it should be good enough if only processing liquid is provided by use of the discharge port group $S_1$.

In this respect, for each area where K is not adjacent to C, it may be possible to provide processing liquid by use of the discharge port group $S_1$ when the discharge port group M or Y passes each of the corresponding K areas.

As regards M and Y, printing is executed by means of the preceding application of processing liquid as in the case of C.

For the execution of the printing method described above, the discharge port group $S_2$ shown in FIG. 4 is not used with respect to the discharge port group K of the head 12*a*. Here, it is not needed. However, for the head 12*b* provided with the discharge port group $S_2$, it may be possible to execute the post application of processing liquid for the discharge port group K at the time of performing a carriage return.

Also, if a head having the discharge port group $S_2$ is used, it is possible to apply the post provision of processing liquid to the area having only black characters, and to apply the preceding provision of processing liquid to the discharge port group K other than those used for such area by use of the discharge port group $S_2$.

Also, with respect to the area where printing should be made in black, the preceding provision of processing liquid is applicable to each boundary portion between K and color, while applying its post provision to the portions other than such boundaries. As a result of the printing operation as described above, it becomes possible to obtain good images.

(Embodiment 3)

Figure 6:
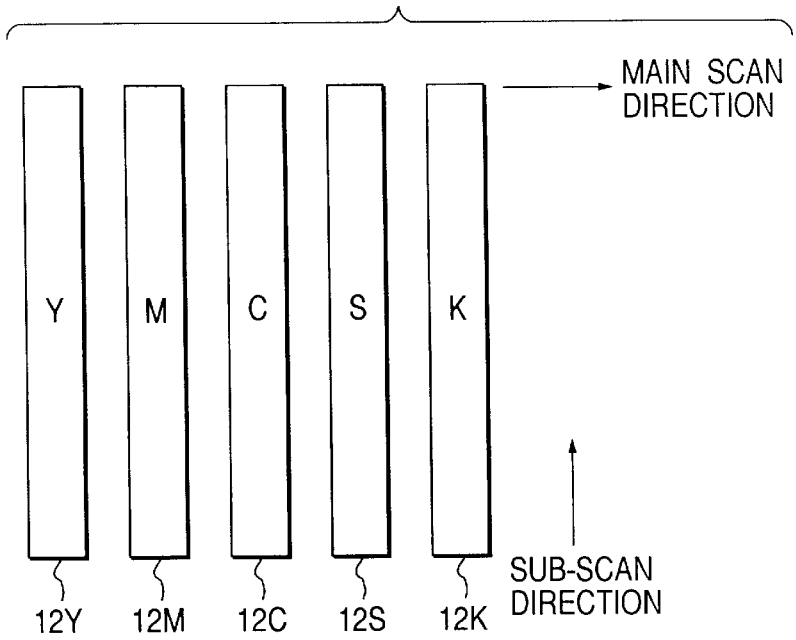
FIG. 6 is a front view which shows still another example of the ink jet printing head suitably applicable to the implementation of the ink jet printing method of the present invention.
Figure 7:
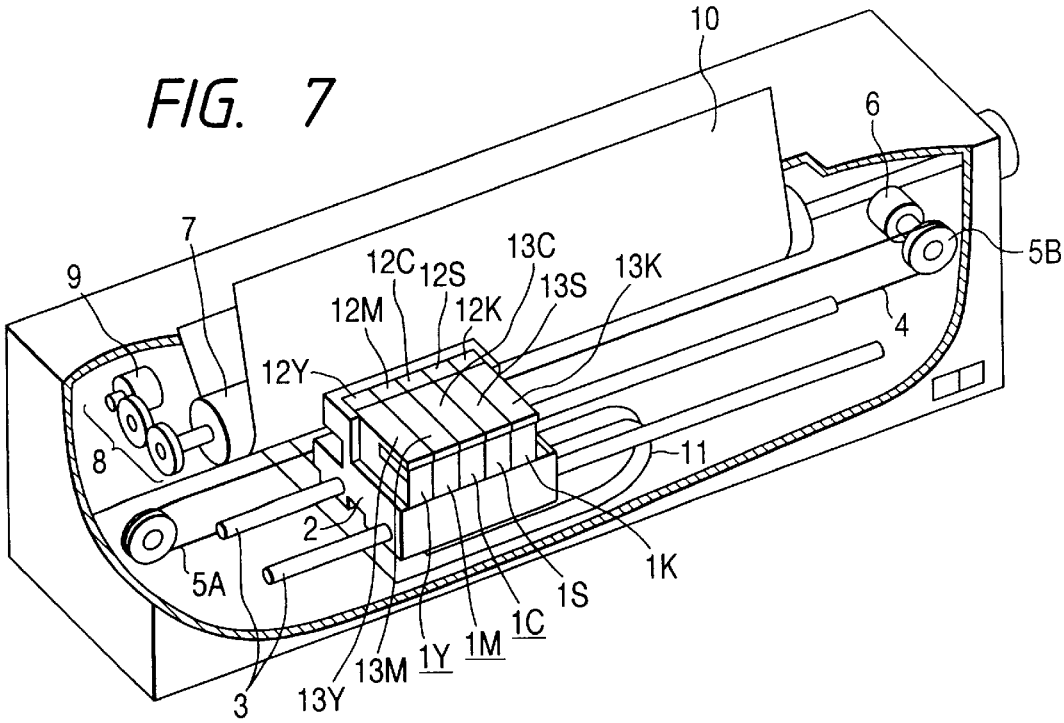
FIG. 7 is a perspective view which schematically shows the principal part of still another example of the ink jet printing apparatus capable of mounting the ink jet head represented in FIG. 6.

FIG. 6 is a front view which schematically shows still another example of the ink jet printing head suitably applicable to the implementation of the ink jet printing method of the present invention. FIG. 7 is a perspective view which schematically shows the principal part of still another example of the ink jet printing apparatus capable of mounting the ink jet head represented in FIG. 6.

In FIG. 6, the ink jet printing head 12Y is specially provided with discharge ports to discharge Y ink (yellow);

head 12M, to discharge M ink (magenta); head 12C, to discharge C ink (cyan); head 12S, to discharge processing liquid; and head K, to discharge K ink (black), respectively. On each of the heads 12Y, 12M, 12C, 12S and 12K, tanks 13Y, 13M, 13C, 13S, and 13K are detachably installed to retain ink of each color and processing liquid, respectively.

In accordance with the present embodiment, it is possible to use the head 12S for the area where printing should be made in K ink (black) to enable the post application of processing liquid, and to use the head 12S for the area where printing should be made in each color ink of Y, M, and C to enable the preceding application of processing liquid.

Also, if an arrangement is made so that the amount of sheet feeding can be set smaller than the head width per feed, and that a printed image is formed for one line portion by use of plural passes, the application of processing liquid can be freely selected. As a result, it becomes possible to use the preceding application thereof or the post one depending on information regarding characters, line drawings, color boundaries, and the like.

(Embodiment 4)

For the present embodiment, the head shown in FIG. 6 is used, but printing is executed by reversing the main scanning direction. In other words, unlike the Embodiment 3, it may be possible to use the head 12S for the application of the post provision of processing liquid to the area where printing should be made in ink of each color of Y, M, and C, and also, to use the head 12S for the application of the preceding provision of processing liquid to the area where printing should be made in K ink.

In accordance with the printing method of the present embodiment, although the quality of images by use of K ink is slightly inferior to those obtainable in each of the preceding embodiments, no bleeding takes place, and also, the amount of processing liquid provided for color portions can be lessened. Therefore, this method is particularly suitable for printing color images having smaller portions where black characters are to be printed.

Now, the processing liquid used for the present invention, which insolubilizes ink dyes, is obtainable as given below as one example.

In other words, after the following compositions are mixed and dissolved, pH is adjusted to 4.8 by use of NaOH, and further, filtered under pressure by use of a membrane filter whose pore size is 0.22 $\mu$m (Product name: Fluoropore filter manufactured by Sumitomo Electric Industries, Ltd.), and then, processing liquid S can be obtained.

| [Component of processing liquid S] | |
|---|---|
| Low molecular component of cationic compound | |
| Stearyl trimethyl ammonium salt (Product name: Electrostripper QE By Kao Corp.) or Stearyl trimethyl ammonium choride (Product name: Utamin 86P By Kao Corp.) | 2.0 |
| High molecular component of cationic compound | |
| Copolymer of diallylamine hydrochloric acid salt and sulfur dioxide (Mean molecular quantity: 5,000) (Product name: Polyamine sulfone PAS-92 By Nitto Boseki Co., Ltd.) | 3.0 |
| Thiodiglycol | 10.0 |
| Water | remainder |

Also, as a preferable example of ink that can be mixed with the aforesaid processing liquid for insolubilization, the following can be named:

In other words, yellow, magenta, cyan, and black ink Yl, Ml, Cl, and Kl are obtainable by mixing the compound given below, which is filtered under pressure by use of a membrane filter whose pore size is 0.22 $\mu$m (Product name: Fluoropore filter By Sumitomo Electric Industries, Ltd.).

| | |
|---|---|
| Y1 | |
| C. I. direct yellow 142 | 2 |
| Thiodiglycol | 10 |
| Acetylenol EH (Manufactured by Kawaken Fine Chemical Co., Ltd.) | 0.05 |
| Water | remainder |
| M1 | |
| With the exception of the dye which is replaced with C. I. acid red 289; 2.5, the composition is the same as that of Y1. | |
| C1 | |
| With the exception of the dye which is replaced with C. I. acid blue 9; 2.5, the composition is the same as that of Y1. | |
| K1 | |
| With the exception of the dye which is replaced with C. I. food black 2; 3, the composition is the same as that of Y1. | |

With each mixture of the processing liquid (liquid component) and ink described above, the processing liquid and ink are mixed on the printing material or in a location where the liquid and ink are permeated into the printing material. Consequently, at the first stage of reaction, the component of low molecular quantity or cationic oligomer in the cationic substance contained in the processing liquid and the water soluble dye having the anionic group used for ink are conjugated by the ionic interaction, and then, separation takes place instantaneously from the solution phase.

Then, as the second stage of reaction, the conjugated body of the dye described above, and the low molecular cationic substance or cationic oligomer is absorbed by the high molecular component contained in the processing liquid. Therefore, the size of the coagulated body of the dye created by conjugation becomes larger still, making it difficult for the body to enter the gaps between textures of a printing material. As a result, only the liquid portion where solid-liquid separation has taken place is permeated into the printing sheet after all. In this way, both the quality of prints and fixing capability are achieved. At the same time, the viscosity of the coagulated body, which is formed by the low molecular component of the cationic substance created by the mechanism described above or the cationic oligomer and anionic dye, becomes larger. Hence, there is no possibility that this body moves along the movement of liquid medium. Therefore, even in the formation of a full color image where adjacent ink dots are formed by ink of different colors, there is no possibility that dots are mixed with each other, and that any bleeding takes place. Also, the coagulated body described above is essentially water insoluble, and the water-resistance capability of images thus formed are perfect. Further, with the shielding effect produced by polymer, the light-proof fastness is effectively enhanced for the images thus formed.

In this respect, the term "insolubilize" or "coagulate" used in the specification hereof means the phenomena appearing only in the first stage described above or for the phenomena including both the first and second stages.

Also, in the implementation of the present invention, there is no need for any use of cationic high molecular substance or polyvalent metallic salt having a large molecular quantity as in the prior art, or even when its use is considered necessary, it should be good enough if only such substance or salt is used supplementally in order to enhance the effect of the present invention still more. Therefore, the amount of its use can be minimized. Consequently, as another effect of the invention, it is possible to solve the problem that the coloring capability of dyes is often lowered when it is intended to obtain water-resistance effect by use of cationic high molecular substance or polyvalent metallic salt.

In this respect, when implementing the present invention, there is no particular limit to the printing materials to be used. The copy sheet, bond paper, and others are suitably usable including the so-called ordinary paper sheets conventionally used for printing. The coated paper specially prepared for use of ink jet printing and the transparent film for OHP use can also be used suitably. The high quality paper and lustrous paper that are generally used are also suitably usable.

Now, particularly among ink jet printing methods, the present invention produces excellent effects on a printing head and a printing apparatus of a method where thermal energy generating means (electrothermal transducing elements, laser beam, or the like, for example) is provided for generating energy to be utilized for discharging ink, and ink is caused to change its state by the application of such thermal energy, because a method of the kind makes it possible to attain printing in high density and high precision.

Regarding the typical structure and operational principle of such method, it is preferable to adopt those which can be implemented using the fundamental principle disclosed in the specifications of U.S. Pat. Nos. 4,723,129 and 4,740,796, for example. This method is applicable to the systems of the so-called on-demand type and a continuous type. Particularly, however, the method is suitable for the on-demand type because the principle is such that at least one driving signal, which provides a rapid temperature rise beyond a departure from nucleation boiling point in response to printing information, is applicable to an electrothermal transducing element disposed on a liquid (ink) retaining sheet or liquid path whereby to cause the electrothermal transducing element to generate thermal energy to produce film boiling on the thermoactive portion of printing means (printing head), thus effectively leading to the resultant formation of a bubble in the printing liquid (ink) one to one in response to each of the driving signals. By the development and contraction of the bubble, the liquid (ink) is discharged through a discharge port to produce at least one droplet. The driving signal is more preferably in the form of pulses because the development and contraction of the bubble can be effectuated instantaneously and appropriately. Therefore, the liquid (ink) is discharged with quicker response. The driving signal in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for an excellent printing in a better condition. The structure of the printing head may be as shown in each of the above-mentioned specifications wherein the structure is arranged to combine the discharging ports, liquid paths, and the electrothermal transducing elements (linear type liquid paths or right-angled liquid paths). Besides, the structure, such as disclosed in the specifications of U.S. Pat. Nos. 4,558,333 and 4,459,600 wherein the thermal activation portions are arranged in a curved area, is also included in the present invention. In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure waves of the thermal energy is formed corresponding to the discharge ports. In other words, it is possible to perform printing reliably and more effectively in accordance with the present invention irrespective of the modes of printing heads.

Further, the present invention is effectively applicable to the printing head of a full-line type having a length corresponding to the maximum width of a printing medium printable by the printing apparatus. For such printing head, it may be possible to adopt either a structure whereby to satisfy the required length by combining a plurality of printing heads or a structure arranged by one printing head integrally formed.

In addition, the present invention is effectively applicable not only to the serial type as described above, but also, applicable to a printing head fixed to an apparatus main body; a printing head of a exchangeable chip type, which is made operative by being electrically connected with an apparatus main body, and receiving ink supply therefrom when mounted on an apparatus main body; or a printing head of a cartridge type where an ink tank is integrally formed with the printing head itself.

Also, for the present invention, it is preferable to additionally provide a printing head with recovery means and preliminarily auxiliary means as constituents of the printing apparatus because these additional means will contribute to making the effectiveness of the present invention more stabilized. To name them specifically, these are capping means, cleaning means, suction or compression means, preheating means such as electrothermal transducing elements or heating elements other than such transducing elements or the combination of those types of elements, and a predischarge means for performing discharge other than the regular discharge with respect to the printing head.

Also, regarding the kinds and numbers of ink jet printing heads to be mounted, the present invention is not only applicable a printing mode in which only one printing head is provided for use of one monochromic ink, but also to an apparatus having plural printing heads provided for use of plural kinds of ink in different colors or densities. In other words, the present invention is extremely effective in applying it to an apparatus provided with at least one of various printing modes using a multi-color of different colors or a full-color of mixed colors, irrespective of whether the printing heads are integrally structured or structured by a combination of plural printing heads.

Furthermore, in the present invention described above, while ink has been described as liquid, it may be an ink material which is solidified below the room temperature but softened or liquefied at the room temperature, or for the ink jet method, since ink is generally controlled within the temperature not lower than 30° C. and not higher than 70° C. in order to stabilize its viscosity for the execution of stable discharges, the ink may be such as to be liquefied when the applicable printing signals are given. In addition, while positively preventing the temperature rise due to the thermal energy by use of such energy as an energy to be consumed for changing states of ink from solid to liquid, or by use of the ink which will be solidified when left intact for the purpose of preventing the ink from being evaporated, it may be possible to adopt for the present invention the use of an ink having a nature of being liquefied only by the application of thermal energy, such as ink capable of being discharged as ink liquid by enabling itself to be liquefied anyway when the thermal energy is given in accordance with printing signals, and also, a kind of ink that will have already begun solidifying itself by the time it reaches a printing medium. In such a case, it may be possible to retain ink in the form of liquid or solid in the recesses or through holes of a porous sheet such as disclosed in Japanese Patent Laid-Open application No. 54-56847 or 60-71260 in order to keep such ink to face the electrothermal transducing elements. In the present invention, the most effective method applicable to various kinds of ink mentioned above is the one capable of implementing the film boiling method as described above.

Moreover, as the mode of the printing apparatus of the present invention, it may be possible to adopt a copying apparatus combined with a reader or the like, in addition to the image output terminal for a computer or other information processing apparatus. Also, it may be possible to adopt a mode of a facsimile equipment having transmitting and receiving functions, among some others.

Figure 8:
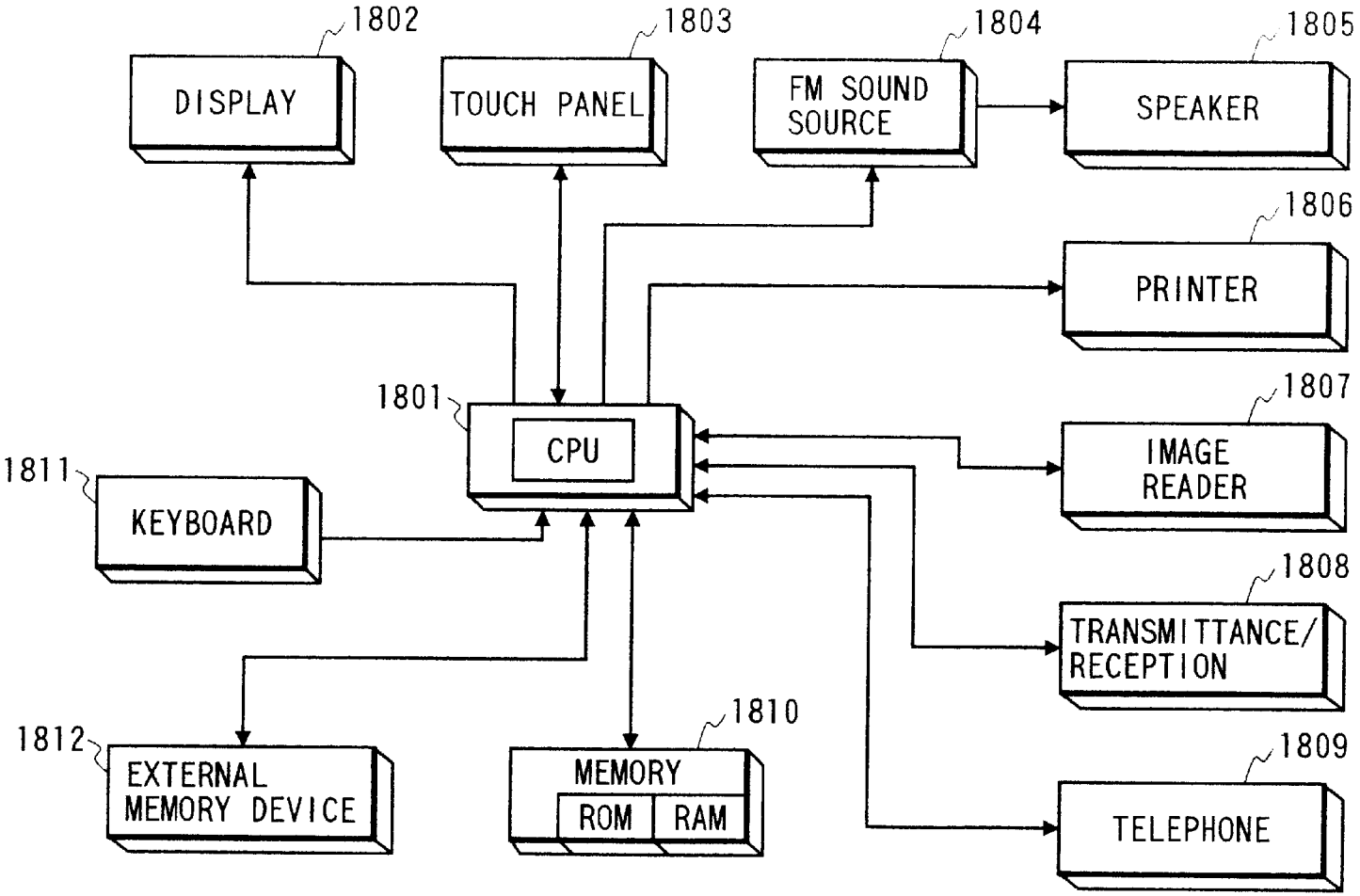
FIG. 8 is a block diagram which schematically shows the structure where the printing apparatus of the present invention is applied to an information processing apparatus having functions as a word processor, a personal computer, a facsimile equipment, and a copying apparatus.

FIG. 8 is a block diagram which schematically shows the structure when the printing apparatus of the present invention is made applicable to an information processing apparatus provided with functions as a word processor, a personal computer, a facsimile equipment, and a copying apparatus.

In FIG. 8, a reference numeral 1801 designates a controller that controls the systems as a whole, which is provided with a CPU of a microprocessor type or the like and various I/O ports in order to output control signals and data signals to each unit, and to receive control and data signals from each unit, thus executing controls as required; 1802, a display unit to indicate various menus, document information, image data read out by a image reader 1807, and some others on its display screen; and 1803, a transparent pressure-sensitive touch panel installed on the display unit 1802, which enables items and coordinate positions to be inputted through the display unit when the surface thereof is depressed by use of a finger or the like accordingly.

A reference numeral 1804 designates an FM (Frequency Modulation) sound generating unit that stores musical information prepared by a musical editor or the like on a memory unit 1810 or an external memory device 1812 as digital data, and then, reads it out from the memory to execute the FM modulation thereof. The electric signals from the FM sound generating unit 1804 are converted to audible sounds by means of a speaker unit 1805. The printer unit 1806 is the one to which the present invention is applicable, and functions as output terminals of a word processor, personal computer, facsimile equipment, and a copying apparatus.

A reference numeral 1807 designates an image reader unit arranged on the carrier path in order to read out data on a source document photoelectrically for input. This unit reads source documents not only for facsimile and copying operations, but also, reads various other documents; 1808, the transmission and reception unit of a facsimile (FAX) equipment that transmits data on source documents read out by the image reader unit 1807 for facsimile operation, and receives facsimile signals being transmitted and demodulates them. This unit has an interface function with external devices. A reference numeral 1809 designates a telephone unit provided with the usual telephone, answer telephone, and various other related functions.

A reference numeral 1810 designates a memory unit that includes a ROM storing a system program, a manager program, and other application programs together with character fonts, dictionaries, and the like, a RAM to store application program and document information loaded from the external memory device 1812, and a video RAM.

A reference numeral 1811 designates a keyboard unit to input document information, various commands, and the like.

The external memory device 1812 uses a floppy disc, a hard disc, and others as storage media to store document information, music or voice information, user application programs, and others.

Figure 9:
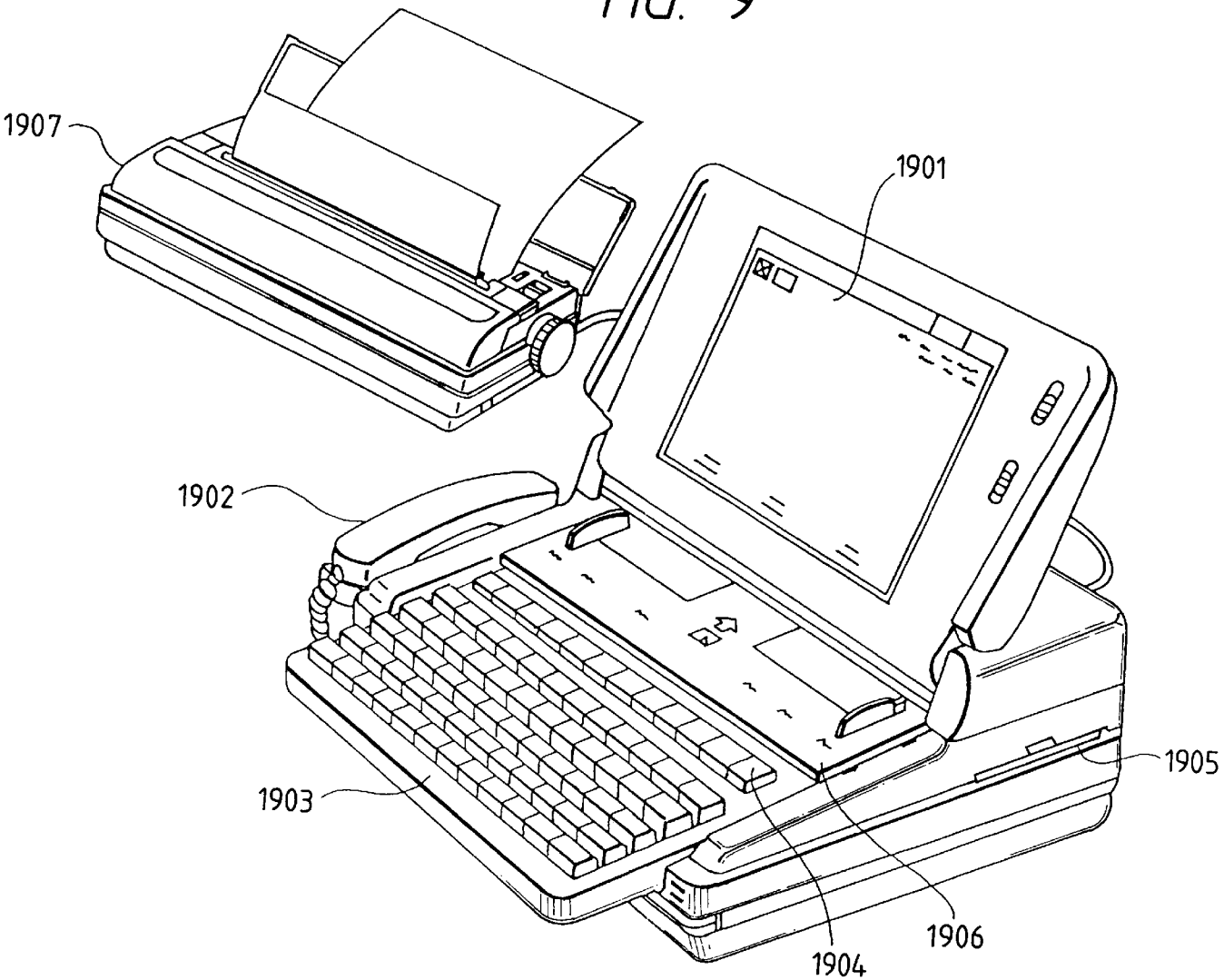
FIG. 9 is a view which schematically shows the outer appearance of the information processing apparatus represented in FIG. 8.

FIG. 9 is a view which schematically shows the information processing apparatus represented in FIG. 8.

In FIG. 9, a reference numeral 1901 designates a flat panel display that utilizes liquid crystal and others and displays various menus, graphic information, document information, and the like. On this display 1901, a touch panel 1803 is installed, which enables coordinates and items to be inputted when its surface is being depressed by use of a finger or the like as required. A reference numeral 1902 designates a hand set to be used when the apparatus functions as a telephone. The keyboard 1903 is detachably connected with the apparatus main body by means of a cord to input various document information and various data. Also, for this keyboard 1903, various functional keys 1904 and others are provided. A reference numeral 1905 designates a floppy disc insertion inlet for the external memory device 1812.

A reference numeral 1906 designates a sheet stacking unit to stack source documents to be read out by means of the image reader unit 1807. The source documents are delivered to the rear portion of the apparatus after reading. Also, for the facsimile reception or the like, the received data are printed by use of the ink jet printer 1907.

In this respect, the display unit 1802 may be a CRT, but it is preferable to use the flat panel of a liquid crystal display type that utilizes ferroelectric liquid crystal. With such display unit, the apparatus can be made smaller and thinner.

When the information processing apparatus described above is made to function as a personal computer or a word processor, each kind of information inputted through the keyboard unit 1811 is processed by the controlling unit 1801 in accordance with a given program, and is output to the printer unit 1806 as images.

When the information processing apparatus functions as the receiver of a facsimile equipment, the facsimile information received from the FAX transmitter through a communication line is processed by the controlling unit 1801 for reception in accordance with a given program, and is output to the printer unit 1806 as reception images.

Also, when the apparatus is made to function as a copying apparatus, a source document is read by the image reader unit 1807, and the data on the source document thus read are output to the printer unit 1806 through the controlling unit 1801 as copied images. In this respect, when the apparatus is made to function as the receiver of the facsimile equipment, the data on a source document read by the image reader unit 1807 are transmitted to a communication line through the FAX transmission and reception unit 1808 after being processed by the controlling unit 1801 for transmission in accordance with a given program.

Figure 10:
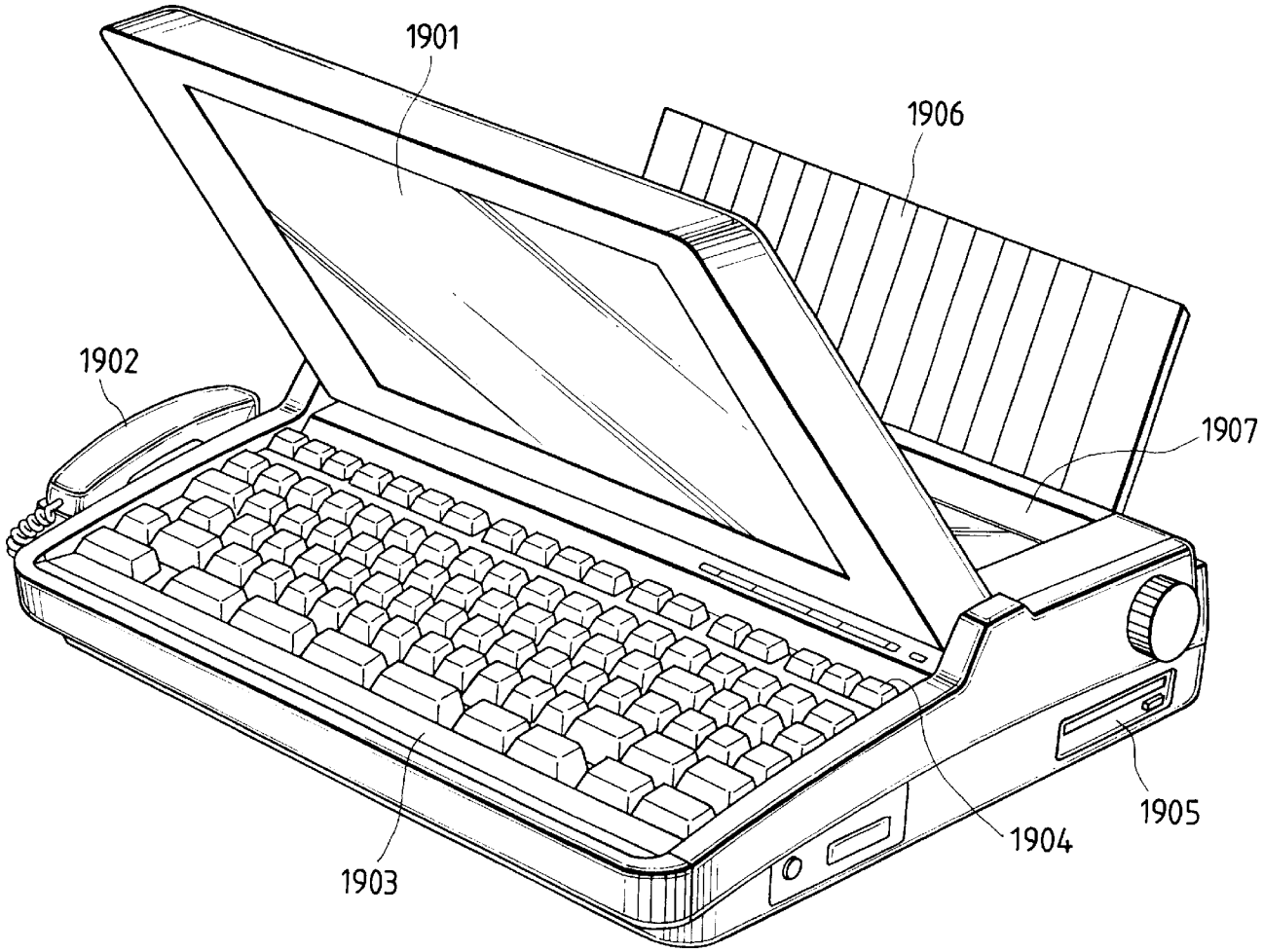
FIG. 10 is a view which schematically shows the outer appearance of one example where the printing apparatus of the present invention is applied to an information processing apparatus.

Here, as shown in FIG. 10, the information processing apparatus described above may be of an integrated type that incorporates an ink jet printer in it. In such case, the portability of the apparatus is further enhanced. In FIG. 10, the corresponding reference marks are applied to those parts where the apparatus has the same functions as those referred to in FIG. 9.

Now, by applying the printing apparatus of the present invention to the multi-functional information processing apparatus that has been described above, it is possible to obtain high-quality images printed at higher speeds with a lesser amount of noises, and to further enhance the functions of such information processing apparatus accordingly.

As described above, in accordance with the present invention, it is possible to obtain sharp images of black characters, and at the same time, to obtain clear images having smaller amount of bleeding at color boundaries between color and color. Also, in accordance with the present invention, the consumption of processing liquid is smaller, thus making it possible to print at lower running costs.

What is claimed is:

1. An ink jet printing method for printing on a printing material with a plurality of inks and a liquid containing a substance insolubilizing or coagulating colorant in the inks, said method comprising steps of:

determining whether image information regarding colors of images to be printed on the printing material is information regarding black color or information regarding colors other than black color;

providing the liquid to an area of the printing material for images to be printed thereon, and then providing the inks when the image information is determined to be the information regarding colors other than black color in said determining step; and providing the inks to the area of the printing material for images to be printed thereon, and then providing the liquid when the image information is determined to be the information regarding black color in said determining step, wherein ink to be used for printing the image information regarding colors other than black color is permeative to the printing material as compared with ink to be used for printing the image information regarding black color.

2. An ink jet printing method according to claim 1, wherein energy utilized for provision of the inks in said providing steps is thermal energy for generating film boiling in the inks.

3. An ink jet printing method for printing on a printing material with a plurality of inks and a liquid containing a substance insolubilizing or coagulating colorant in the inks, said method comprising steps of:

determining whether image information regarding colors of images to be printed on the printing material is information regarding black character or information regarding colors other than black;

providing the liquid to an area of the printing material for images to be printed thereon, and then providing the inks when the image information is determined to be the information regarding colors other than black in said determining step; and providing the inks to the area of the printing material for images to be printed thereon, and then providing the liquid when the image information is determined to be the information regarding black character in said determining step.

4. An ink jet printing method according to claim 3, wherein energy utilized for provision of the inks in said providing steps is thermal energy for generating film boiling in the inks.

5. An ink jet printing apparatus for printing with a plurality of inks and a liquid containing a substance insolubilizing or coagulating colorant in the inks, said apparatus comprising:

means for discharging the inks;

means for discharging the liquid;

means for determining whether image information regarding colors of images to be printed on the printing material is information regarding black color or information regarding colors other than black color; and printing control means for controlling printing by i) providing the liquid to an area of the printing material for images to be printed thereon, and then providing the inks when the image information is determined to be the information regarding colors other than black color by said determining means, and ii) providing the inks to the area of the printing material for images to be printed thereon, and then providing the liquid when the image information is determined to be the information regarding black color by said determining means, wherein ink to be used for printing the image information regarding colors other than black color is permeative to the printing material as compared with ink to be used for printing the image information regarding black color.

6. An ink jet printing apparatus according to claim 5, wherein said means for discharging inks comprises thermal energy generating elements for generating thermal energy for discharging the inks.

7. An ink jet printing apparatus for printing on a printing material with a plurality of inks and a liquid containing a substance insolubilizing or coagulating colorant in the inks, said apparatus comprising:

means for discharging the inks;

means for discharging the liquid;

means for determining whether image information regarding colors of images to be printed on the printing material is information regarding black character or information regarding colors other than black; and printing control means for controlling printing by i) providing the liquid to an area of the printing material for images to be printed thereon, and then providing the inks when the image information is determined to be the information regarding colors other than black by said determining means, and ii) providing the inks to the area of the printing material for images to be printed thereon, and then providing the liquid when the image information is determined to be the information regarding black character by said determining means.

8. An ink jet printing apparatus according to claim 7, wherein said means for discharging inks comprises thermal energy generating elements for generating thermal energy for discharging the inks.

* * * * *